US005086638A

United States Patent [19]

David

[11] Patent Number: 5,086,638

[45] Date of Patent: Feb. 11, 1992

[54] DRIVE MECHANISM FOR A HEMMING APPARATUS

[75] Inventor: Michael W. David, Sparta, Mich.

[73] Assignee: Link Special Machinery, Inc., Comstock Park, Mich.

[21] Appl. No.: 682,724

[22] Filed: Apr. 9, 1991

[51] Int. Cl.[5] ..... B21J 9/18

[52] U.S. Cl. ..... 72/451; 72/312; 29/243.58; 100/272

[58] Field of Search ..... 72/312, 313, 314, 315, 72/319, 451, 450, 452, 48; 29/243.5, 243.58; 100/272, 281

[56] References Cited

U.S. PATENT DOCUMENTS

| | | | |
|---|---|---|---|
| 3,092,057 | 6/1963 | Warshilek | 29/243.58 |
| 3,147,726 | 9/1964 | Tribe | 29/243.58 |
| 3,191,414 | 6/1965 | Kollar et al. | 72/48 |
| 3,276,409 | 10/1966 | St. Denis . | |
| 3,598,073 | 8/1971 | St. Denis . | |
| 4,706,489 | 11/1987 | Dacey, Jr. | 72/450 |
| 4,901,555 | 2/1990 | Shimoichi | 72/322 |

OTHER PUBLICATIONS

Brochure Entitled, "Instructions for Adjusting Hemming Machines" from E. R. St. Denis & Sons Limited, of Oldcastle, Ontario, Canada.

Sales Brochure from E. R. St. Denis & Sons Limited, of Oldcastle, Ontario, Canada, Entitled "Quality, Efficient Hemming Machines."

*Primary Examiner*—David Jones

*Attorney, Agent, or Firm*—Varnum, Riddering, Schmidt & Howlett

[57] ABSTRACT

A drive mechanism for a hemming apparatus includes a pneumatic cylinder pivotally mounted to a frame which is suspended from a bed on which the workpiece can be positioned. The reciprocating shaft of the pneumatic cylinder is pivotally connected to the knee of a toggle joint. One end of the toggle joint is pivotally connected to the frame, and the other end of the toggle joint is pivotally connected to a lever. The fulcrum of the lever is pivoted on the frame, and the other end of the lever is connected to a draw rod. The draw rod is adapted to pull a movable member into operative engagement with the workpiece in one or two stages to complete the hem.

20 Claims, 9 Drawing Sheets

DRIVE MECHANISM FOR A HEMMING APPARATUS

BACKGROUND OF THE INVENTION

1. Field of the Invention

This invention relates to a hemming apparatus, and more particularly to the drive mechanism for causing a hemming tool to form a hem between a pair of overlapped metal pieces at the peripheral part of a workpiece.

2. Description of the Prior Art

Hemming is a technique that is widely used in the automotive industry for joining a sheet of metal that serves as an external body component to a formed piece of metal that serves as a reinforcing element for the external body component. It is also used in the white goods industries for seaming two pieces of sheet metal together. As an example, a door of most automotive vehicles is of a two-piece construction in which the outer edge of the outer element of the door is folded over against the outer edge of an inner reinforcing element by a hemming process. Devices for performing hemming operations of the type described are shown in U.S. Pat. No. 4,706,489 to Dacey, Jr., and U.S. Pat. No. 4,901,555 to Shimoichi.

Hemming processes as heretofore described generally utilize an outer element with the outer edge prefolded in the form of a flange to lie approximately perpendicularly to the main portion of the outer element, such prefolding being done most conveniently in the stamping operation that is customarily utilized in the forming of such outer element. The hemming of the flange requires that it be folded over from the prefolded condition approximately 90 degrees, to be against the outer edge of the inner element, after the inner element, whose main portion extends generally parallel to the main portion of the outer element, has been placed inside the flange of the outer element. The folding over or hemming of the flange of the outer element in many hemming processes of the prior art is done in multiple stages, usually in two stages. In a first stage, force is applied generally perpendicularly to the original orientation of the flange to cause it to bend approximately 35° to 55° from its original orientation. In the second stage, force is applied generally parallel to the original orientation of the flange to cause the partially bent flange to bend an additional approximately 55° to 35° to complete the approximately 90° of folding of the flange from its prefolded condition to securely engage the outer edge of the inner element of the two-piece structure that is being hemmed.

An illustration of the sequence of a two-stage hemming operation is shown in FIG. 10. It can be seen that a workpiece comprises an inner element overlying an outer element adjacent an upstanding flange of the outer element. The workpiece rests on a bed of the apparatus, typically against a brace. A hemming tool is moved horizontally to a first position over the bed, and then drawn towards the bed in the first stage to an operative position where the tool engages the upstanding flange causing it to bend preliminarily from its original orientation. The tool is then withdrawn, and moved horizontally to a second-stage position, whereupon it is again urged vertically toward the bed to the operative position where the second-stage force is applied to the flange to complete the hemming operation.

It has been recognized that there are advantages with performing an entire hemming operation in a single set of tooling, as disclosed in U.S. Pat. No. 3,191,414 to Kollar, et al., and in U.S. Pat. No. 3,276,409 to St. Denis. The Kollar et al. patent describes a hemming tool that is actuated sequentially in horizontal and vertical directions by separate hydraulic cylinders acting through a linkage system. Such hydraulic structures are typically massive, costly, and complex. It has been found advantageous to use pneumatic systems for driving hemming tools. E. R. St. Denis & Sons Limited manufactures typical air-operated hemming machines.

Existing pneumatic hemming machines utilize an upper steel which supports the hemming tool, and which is urged toward the bed by means of a draw rod. The draw rod is connected, usually by a lever, to the shaft of a pneumatic cylinder, the lever serving to amplify the force of the pneumatic cylinder. One of the disadvantages of existing pneumatic hemming machines is a limitation on the amount maximum force which can be delivered to the hemming tool for application to the workpiece. However, since a typical hemming station requires the use of several hemming tools arranged end to end around the perimeter of the parts that are joined to one another, there is a limit to the size and weight of the driving mechanism that can be accommodated for each tool.

SUMMARY OF THE INVENTION

According to the present invention, there is provided an improved drive mechanism for a hemming apparatus by which a greater force can be transmitted to the workpiece than heretofore available in the prior art. A typical hemming apparatus to which the invention is applicable has a bed adapted to receive a workpiece comprising at least two superimposed sheet materials to be hemmed, and a tool mounted to a movable member adapted to move toward and away from an operative position, with the tool being disposed to engage the workpiece when the movable member is in the operative position. In accordance with the invention, the drive mechanism comprises a frame fixedly mounted to the bed. A pneumatic cylinder is pivotally mounted to the frame with the cylinder having a shaft extending therefrom for reciprocating movement. A toggle joint having first and second arms and a knee is provided with the knee being pivotally connected to the shaft and the first arm being pivotally mounted to a lower portion of the frame. A lever having first and second ends is pivotally mounted to an upper portion of the frame at a point intermediate the first and second ends. The first end of the lever is pivotally connected to the second arm. A draw rod has one end pivotally connected to the second end of the lever and another portion of the draw rod is connected to the movable member. Given this structure, when the pneumatic cylinder is energized, the shaft, the toggle joint, the lever, and the draw rod will cooperate to urge the movable member toward the operative position.

Preferably, the frame is suspended from the bed, and the pivotal connections of the toggle joint with the lower portion of the frame and the first end of the lever, respectively, are substantially in vertical alignment with the tool. Also, according to a preferred embodiment, the first arm comprises a pair of parallel links which straddle and are pivotally connected to the second arm at the knee.

In another aspect of the invention, the movable member comprises a block which supports the tool, and the draw rod has means for adjusting the position of the block relative to the second end of the lever. The adjusting means finds its genesis in a threaded end of the draw rod extending through an aperture in the block, with a pull nut being threaded onto the end.

In another aspect of the invention, an actuating mechanism is mounted to and between the frame and the movable member so that the movable member is adapted to move toward and from a first-stage position and a second-stage position. The first-stage position is defined as being a location above the bed from which the movable member is displaced vertically so that the tool can preliminarily bend the workpiece when the movable member is in the operative position. The second-stage position is a location above the bed from which the movable member is displaced vertically whereby the tool can secondarily bend the workpiece when the movable member is in the operative position. Preferably, the actuating mechanism comprises a pneumatic cylinder, and may also include first and second pneumatic cylinders in axial alignment.

The nature of the invention will be more clearly understood by reference to the following detailed description, the appended claims, and the several views illustrated in the accompanying drawings.

DETAILED DESCRIPTION OF THE DRAWINGS

Figure 1:
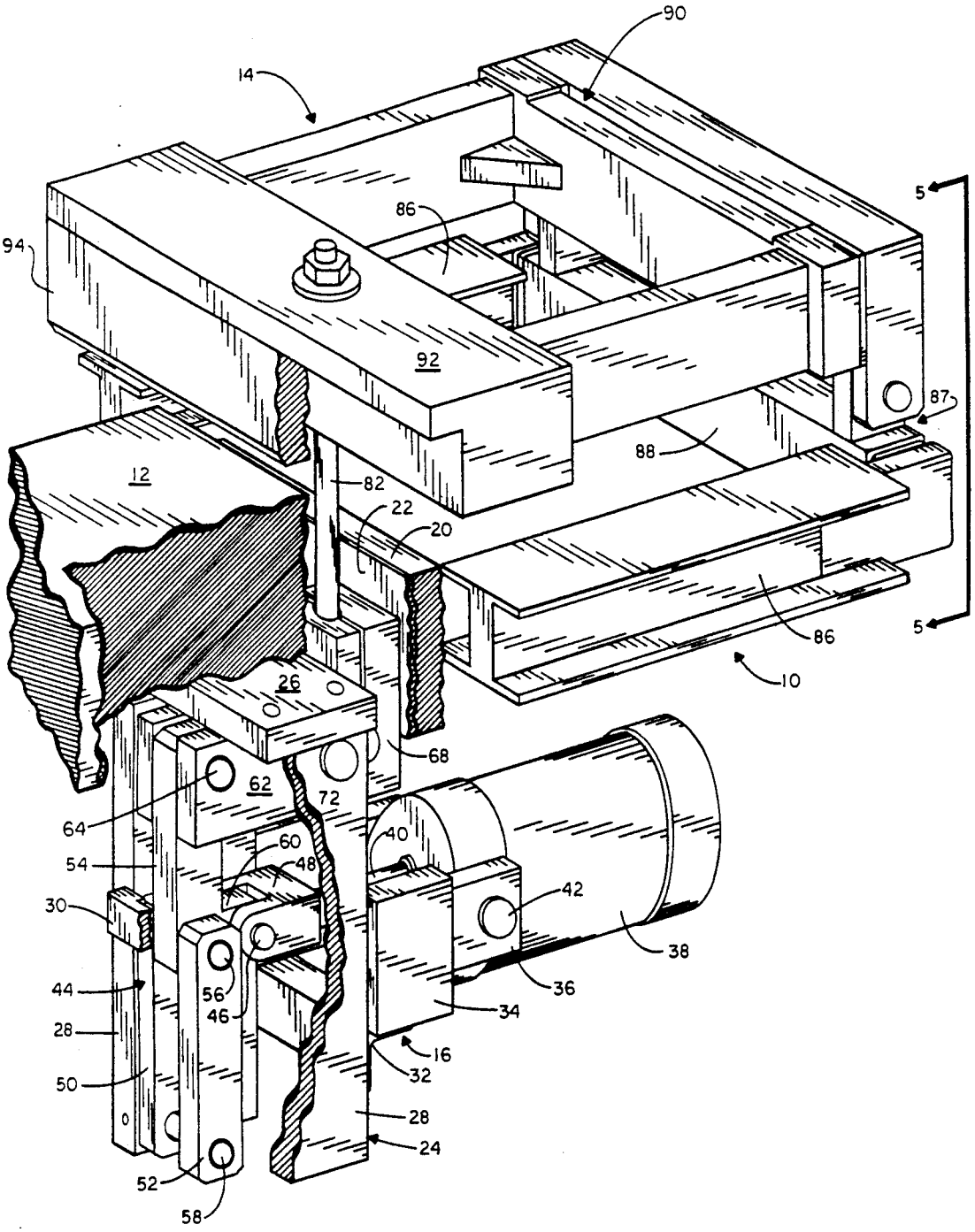
FIG. 1 is an isometric view of a hemming tool according to the present invention.

A hemming device according to the invention is shown generally at 10 in FIG. 1, with portions broken away to show detail. The device 10 is mounted to a bed 12 which is adapted to receive a workpiece. It will be understood that, in a conventional manner well known in the art, the bed will have a form corresponding to the shape of the part to be hemmed, and there will typically be a series of hemming devices 10 arranged end to end in an annular pattern around the bed.

Figure 6:
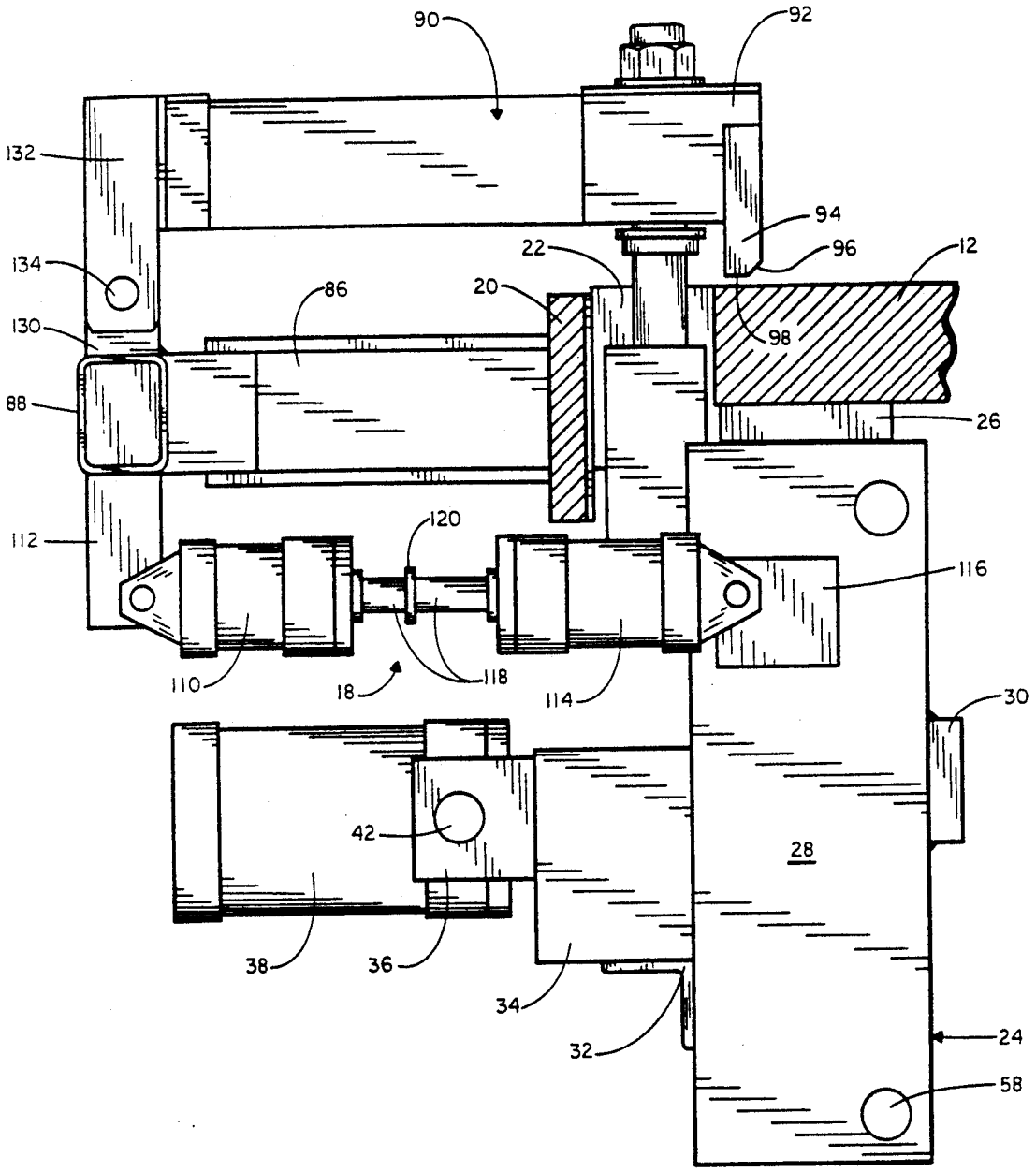
FIG. 6 is an elevational view of the hemming tool of FIG. 1.

Looking more closely now at FIGS. 1 and 6, it can be seen that FIG. 6 is an elevational view of the hemming device 10 from the other side of the view illustrated in FIG. 1. The hemming device 10 comprises generally a tooling portion 14, a drive mechanism 16, and an actuating mechanism 18. The tooling portion 14 is mounted to the bed by a frame member 20. The frame member 20 may be an extension of the bed, or may be a separate member fixedly secured to the bed, but in any event provides a space 22 for a portion of the drive mechanism 16 to extend from beneath the bed 12 to a position above the bed.

The drive mechanism 16 is suspended from the bed 12 by means of a frame 24. The frame 24 comprises a mounting support plate 26 which is rigidly secured to the bed 12. A pair of side plates 28, substantially parallel and spaced from each other, depend from the mounting support plate 26. A brace 30 extends between the side plates 28 at a front portion thereof, and an angle bracket 32 extends between the side plates 28 at a rear portion thereof. Extending rearwardly from each side plate and secured to an upper portion of the angle bracket 32 is a spacer plate 34. A pair of trunnion blocks 36 extend further rearwardly from the spacer plates 34. A conventional pneumatic cylinder 38 having a shaft 40 extending therefrom for reciprocating movement is pivotally mounted to the trunnion blocks 36 at pivotal connection 42. The shaft 40 extends from the pneumatic cylinder 38 into the space between the side plates 28 of the frame 24.

A toggle joint 44 is disposed within the frame 24 and pivotally connected at 46 to a clevis 48 on the end of the shaft 40. The toggle joint 44 comprises a pair of lower links 50, 52 which are connected to an upper link 54 at a knee joint 56. The lower links 50, 52 preferably straddle the upper link 54 at the knee joint 56, and together form a lower arm of the toggle joint 44. The lower links 50, 52 are pivotally connected at the lower ends thereof to the side plates 28 by a pin 58.

The upper link 54 preferably is L-shaped, having a rearward extension 60. The clevis 48 is connected to the rearward extension 60 at the pivotal connection 46, but it is understood that the clevis 48 could easily be adapted to connected directly to the knee joint 56.

The other end of the upper link 54 is pivotally connected to a lever 62 at a pivotal connection with a pin 64. The lever 62 is preferably yoke-s with the upper link 54 connected between the two arms 65 the yoke at one end of the lever. A block 66 projects from the yoke at a second end of the lever 62 and is pivotally connected to a draw rod mount 68 by a pin 70. The lever 62 is pivotally connected by pin 72 to the side plates 28 of the frame 24. The pivotal connection 72 is at a point on the lever intermediate the first and second ends of the lever.

The draw rod mount 68 is a yoke-shaped block having spaced-apart parallel arms 74 and a block portion 76.

Figure 7:
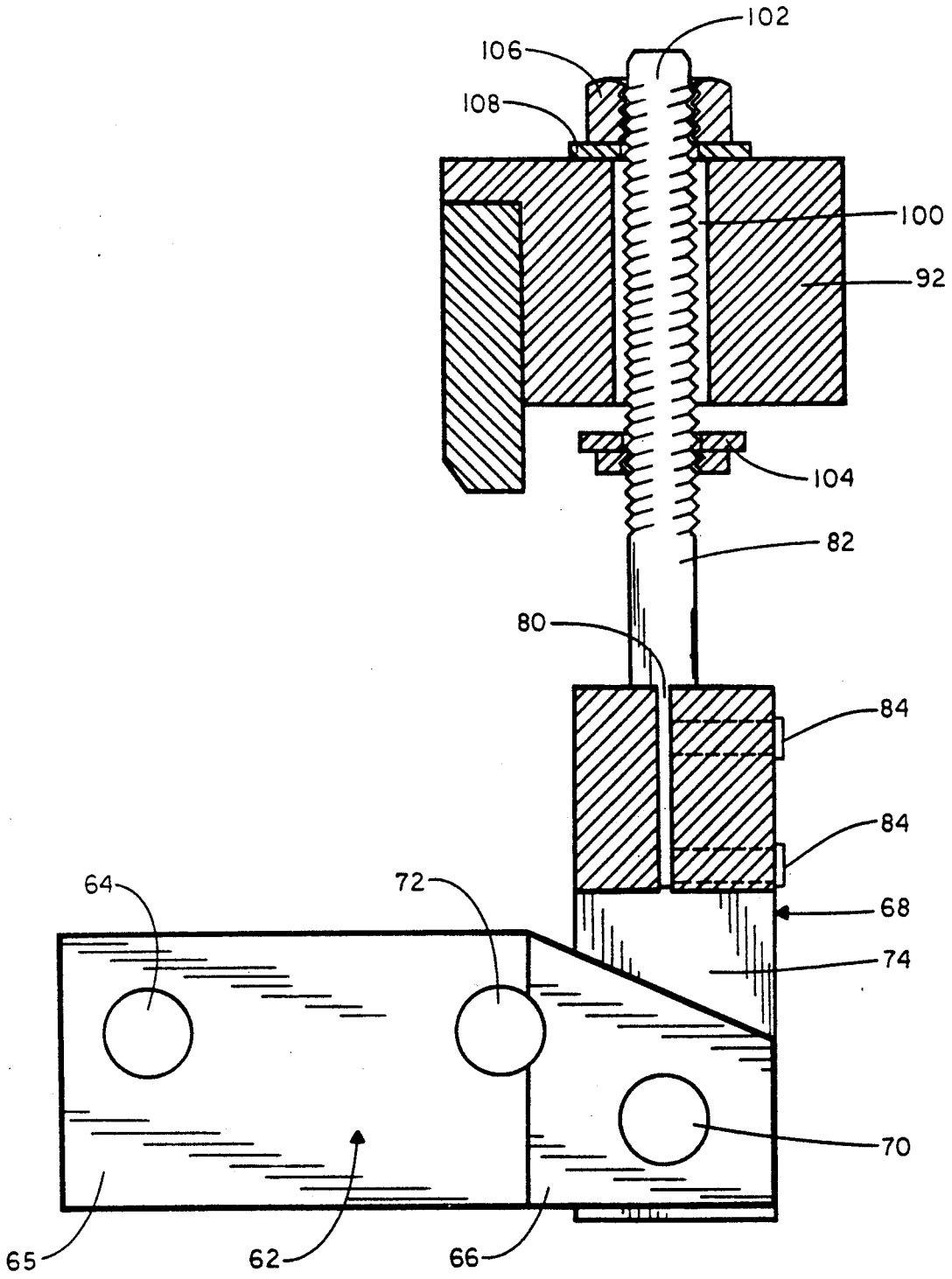
FIG. 7 is a cross-sectional view of the draw rod and its connections.
Figure 9:
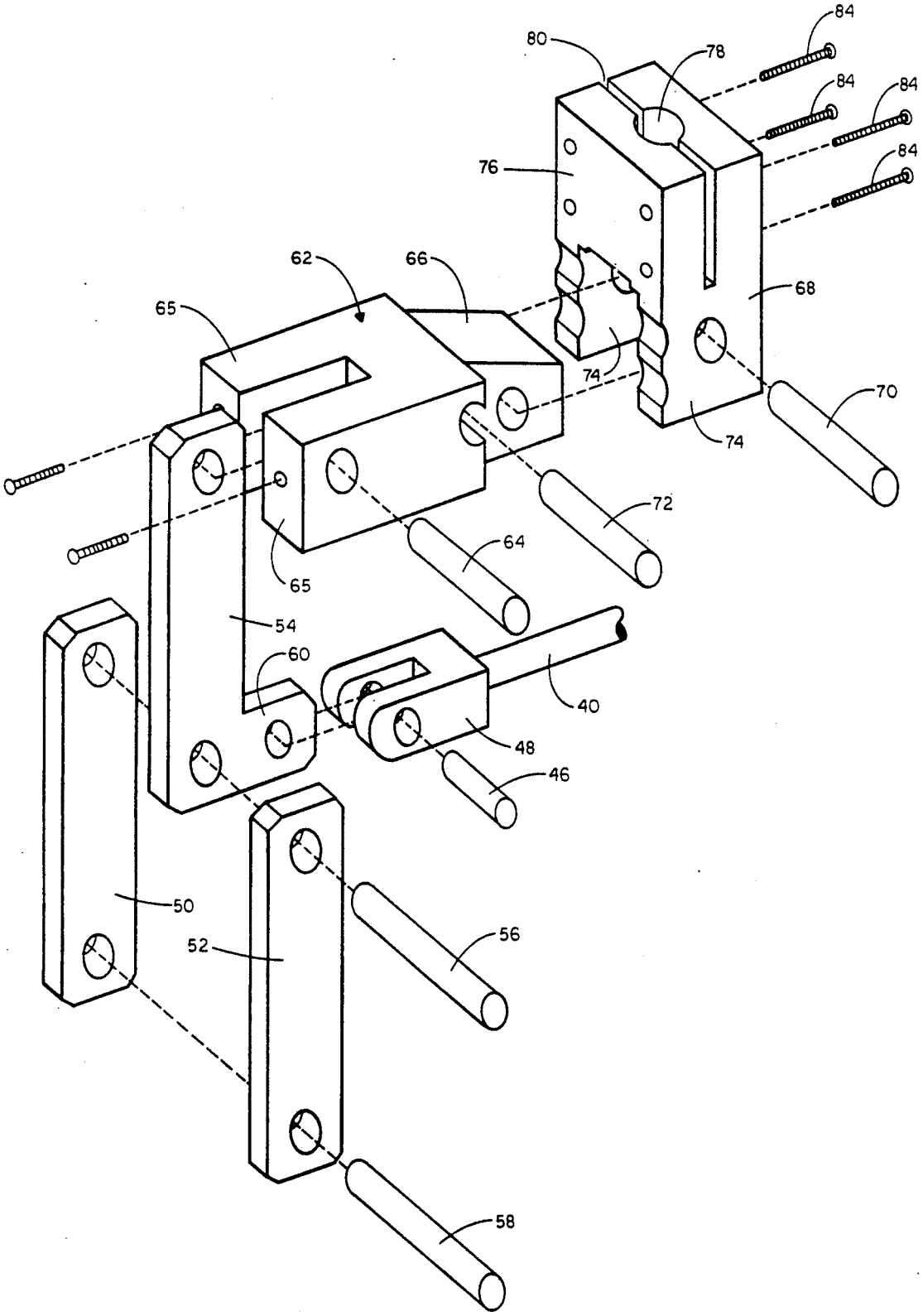
FIG. 9 is an exploded view depicting a portion of the drive mechanism of the hemming tool illustrated in FIG. 1.
Figure 10:
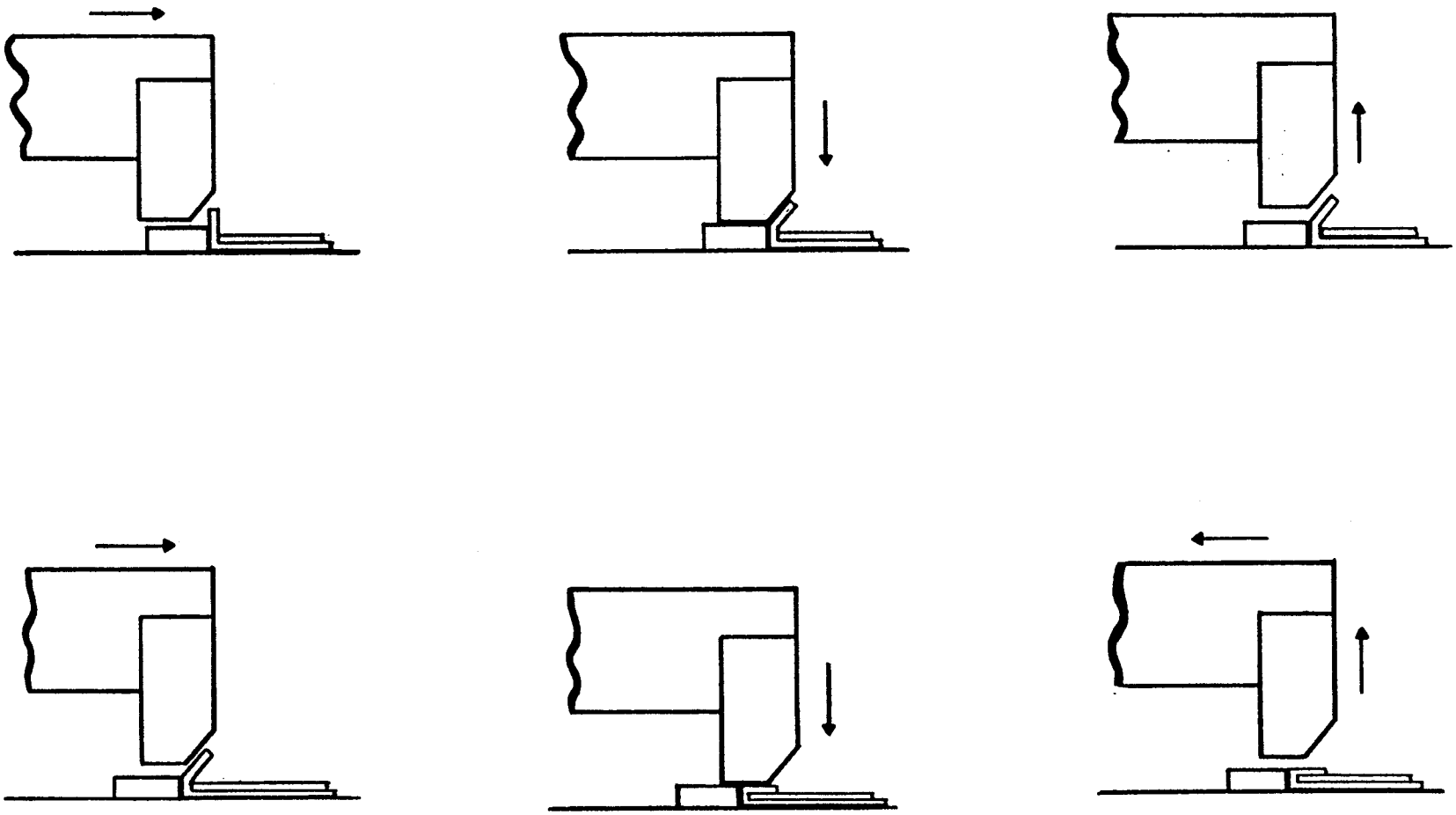
FIG. 10 is a schematic illustration of a two-stage hemming operation.

Looking now at FIGS. 7 and 9, the draw rod mount 68 includes a threaded aperture 78 in the block portion 76 with a slot 80 extending transversely through the block portion and the aperture. A draw rod 82 is threaded into the aperture 78 where it is clamped securely into the block portion 76 by bolts 84.

Looking again at FIGS. 1 and 6, the tooling portion 14 comprises a pair of braces 86 extending rearwardly from the frame member 20. The braces 86 are generally parallel and spaced from each other. A tube 88 extends between and is pivotally connected to the braces 86 at connection 87. A movable member 90 is pivotally connected to the tube 88. The movable member 90 is of generally open, rectangular construction but sufficiently strong to withstand large forces. The movable member 90 comprises a tool support block 92 which has a longitudinal dimension generally parallel to the periphery of the bed 12. A tool 94 of conventional construction is secured to the tool support block by means well known to those skilled in the art. The tool 94 has a first face 96 adapted for preliminary bending, and a second face 98 adapted for secondary bending.

Looking now at FIG. 7, it can be seen that the draw rod 82 extends upwardly through an aperture 100 in the tool support block 92 and has an end 102 projecting above the block. The end 102 is threaded, but it will be apparent that the aperture 100 is not so that the draw rod 82 is free to reciprocate through the aperture 100 relative to the block 92. Mounted to the draw rod intermediate the block 92 and the draw rod mount 68 is a push nut 104. The push nut 104 may be threaded onto the draw rod end 102 or may be permanently secured thereto by any other well-known means. A pull nut 106 is threaded onto the second end 102, preferably with a wear washer 108, and is not permanently secured to the draw rod 82. It remains rotatable to permit adjustment in a manner hereafter described.

Referring again to FIG. 6, the actuating mechanism 18 comprises a first pneumatic cylinder 110 which is pivotally connected to an arm 112 rigidly secured to the tube 88. A second cylinder 114 is pivotally mounted to a bracket 116 which is rigidly secured to one of the side plates 21 of the frame 24. The first and second cylinders 110, 114 are in axial alignment, facing each other, so that the shafts 118 thereof are joined as at 120. When one or both of the cylinders 110, 114 are energized, the tube 88 is rotated relative to the braces 86, and this motion imparts a horizontal movement of the movable member 90 relative to the bed 12. In this manner, the movable member 90 can be moved toward and away from a first stage and a second stage, as will be further described hereinafter.

Figure 5:
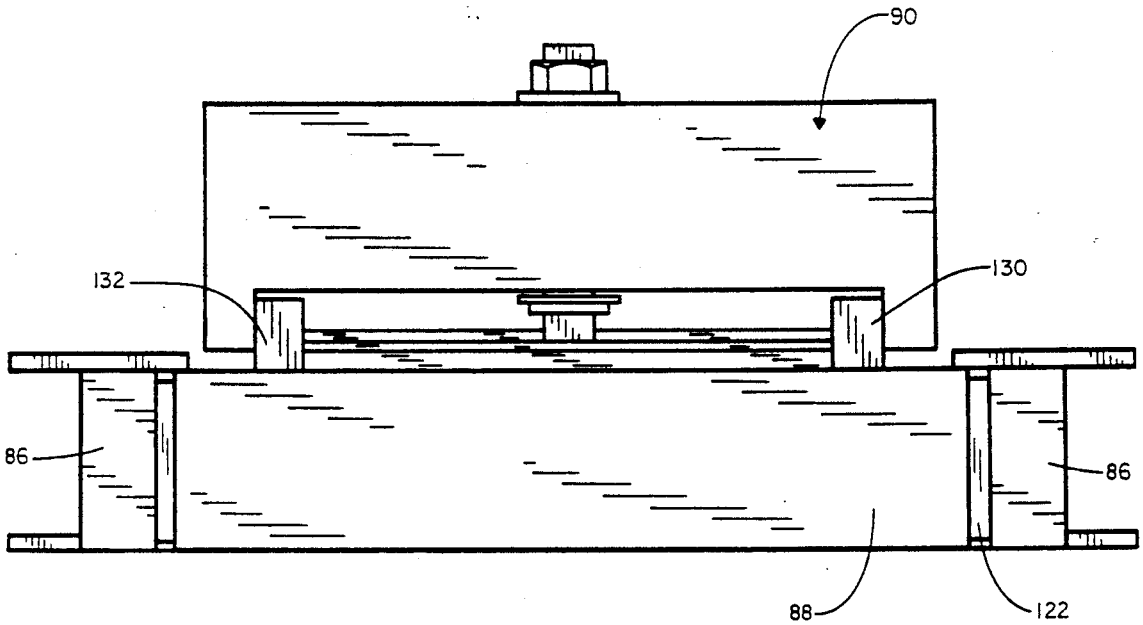
FIG. 5 is a sectional view taken along line 5—5 of FIG. 1.
Figure 8:
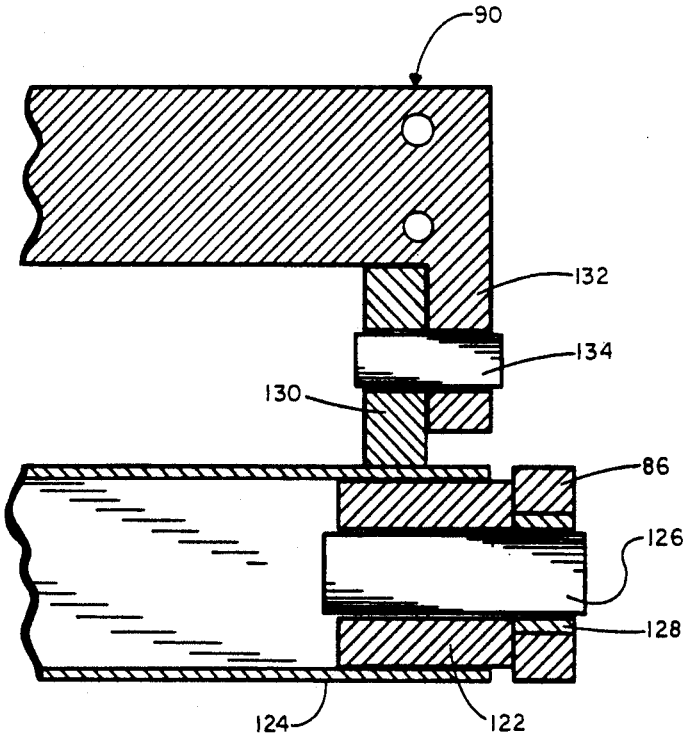
FIG. 8 is a sectional view taken along line 8—8 of FIG. 1.

Looking now at FIGS. 5 and 8, the pivotal connection 87 between the tube 88 and the braces 86 can be more clearly shown. A plug insert 122 is received into each end 124 of the tube 88. A shaft 126 is press-fit into the plug insert and extends outwardly therefrom. Each shaft 126 is received in a corresponding aperture of the adjoining brace 86 by means of a bushing 128 thereby forming the bushed connection 87.

It can also be seen that a pair of ears 130 extend upwardly from the tube 88. The movable member 90 has a pair of depending arms 132 which are pivotally mounted to the corresponding ears 130 by means of a pin 134.

Referring again to FIG. 6, it can be seen that when the actuating mechanism 18 is energized, either by extending or retracting the shafts 118, the tube 88 is caused to rotate relative to the brace 86. This rotation throws the ears 130 in an arc about the tube, and, in cooperation with the pin 134, imparts a relatively horizontal movement of the movable member 90 relative to the bed 12.

Figure 2:
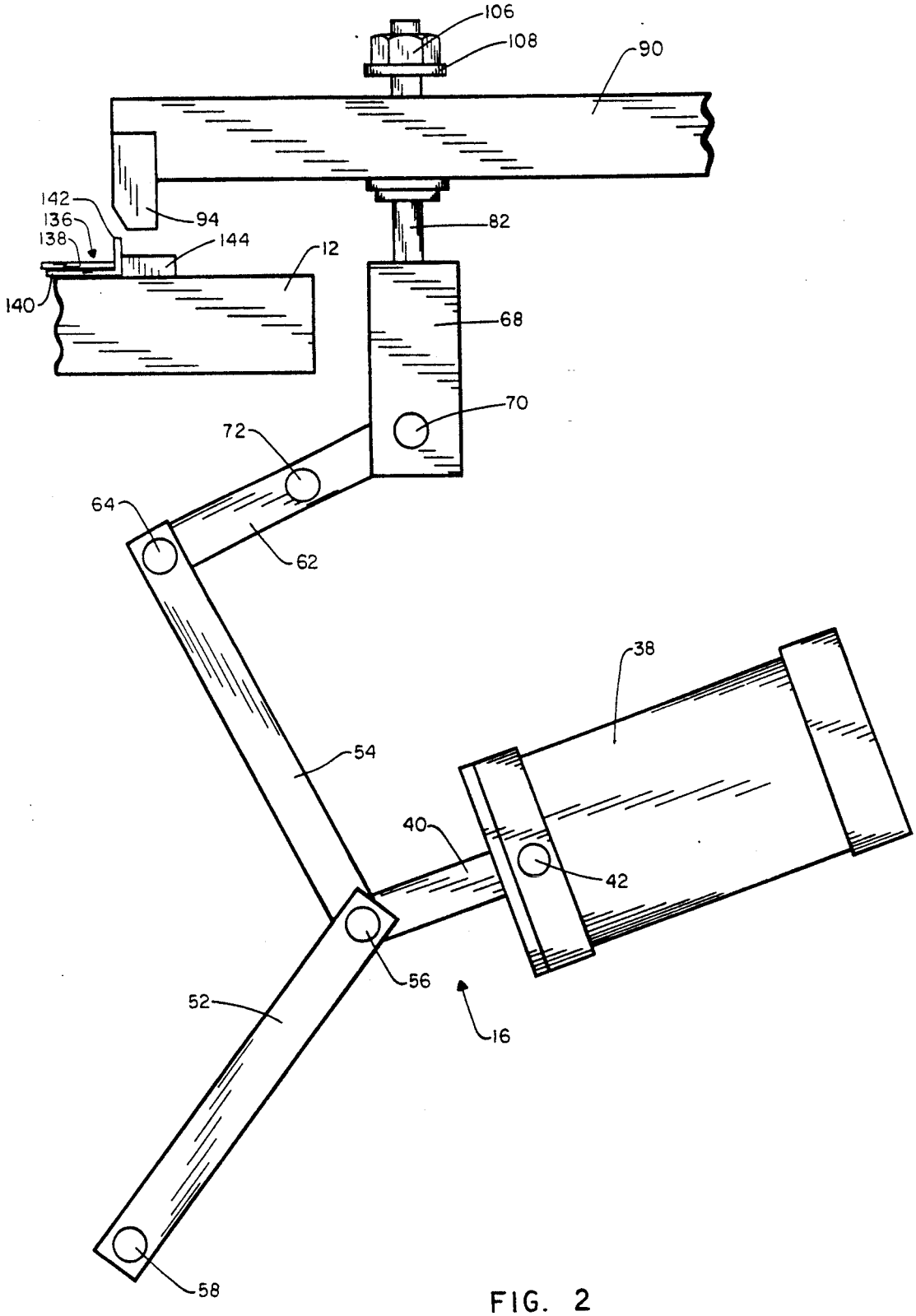
FIG. 2 is a schematic view of the drive mechanism of the hemming tool of FIG. 1 where the tool is away from the operative position.
Figure 3:
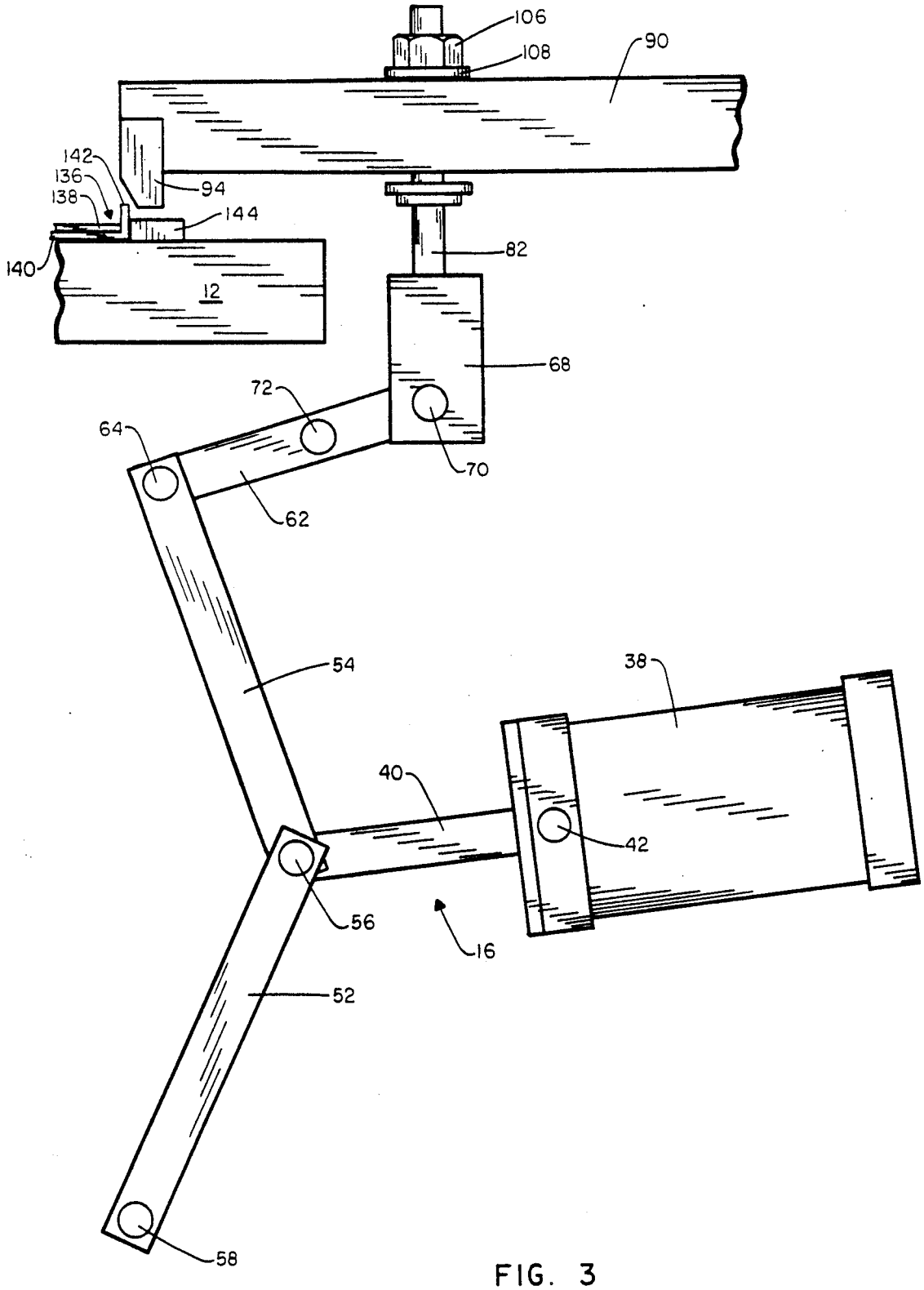
FIG. 3 is a schematic view similar to FIG. 2 where the tool is being urged toward the operative position.
Figure 4:
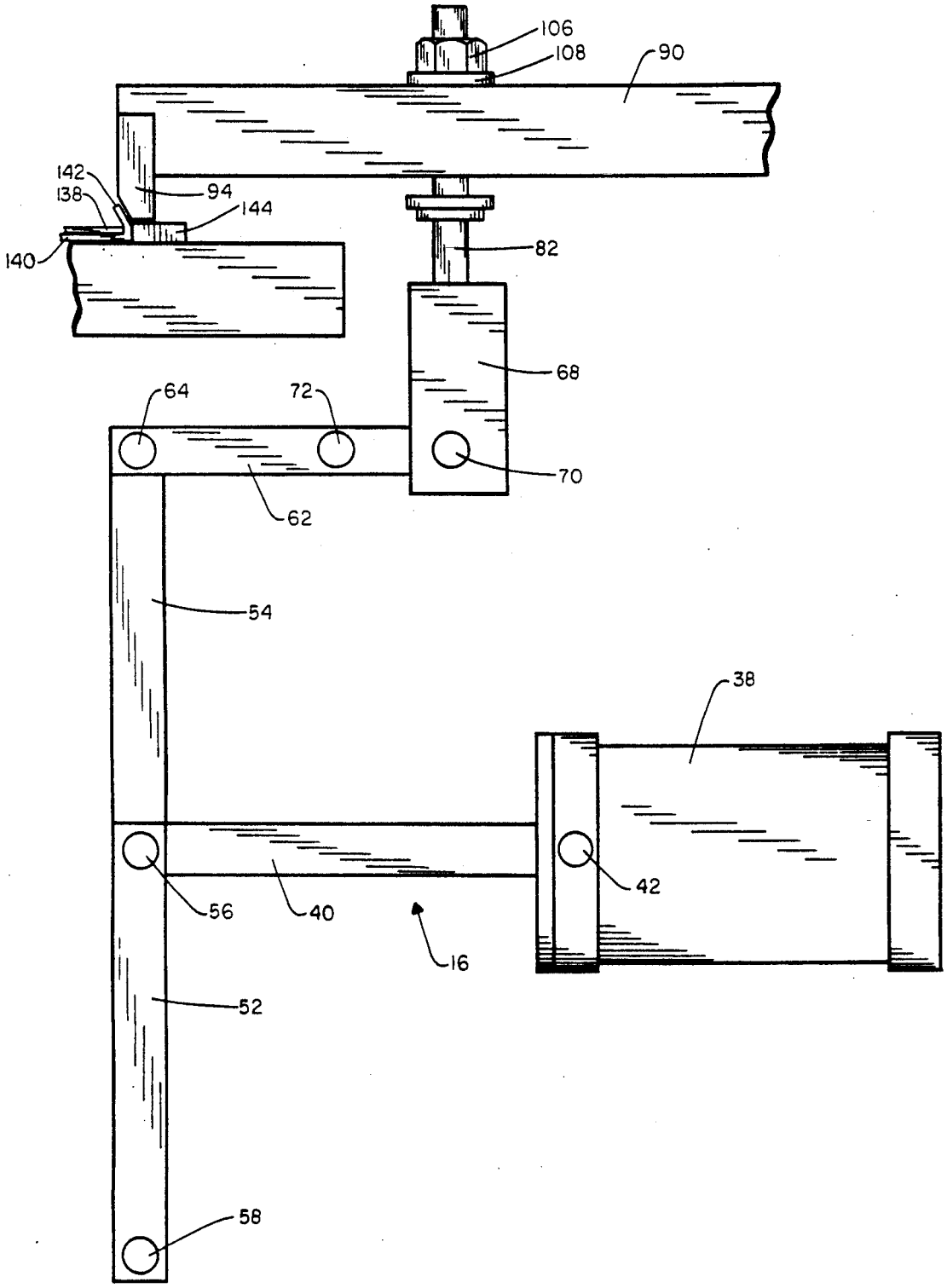
FIG. 4 is a schematic figure similar to FIGS. 2 and 3 where the hemming tool is in the operative position.

Operation of the hemming apparatus is illustrated schematically in FIGS. 2 through 4. In conventional manner, the workpiece 136 which comprises an inner element 138 and an outer element 140 is placed on the bed 12. The outer element 140 has a preformed flange 142 which abuts a brace 144. The drive mechanism 18 starts from a position shown in FIG. 2 where in the shaft 40 is retracted relative to the pneumatic cylinder 38. In this position, the knee joint 56 is retracted, causing the lever 62 to push the draw rod 82 upwardly, thus moving the tool 94 away from the operative position. As the shaft 40 is extended, force is transmitted to the lever 62 causing the draw rod to pull downwardly, which brings the movable member 90 with it. As the knee joint is further extended so that the upper and lower links approach 180° with respect to each other, the tool 94 is brought into the operative position where it engages the workpiece 136 and bends the flange 142. In the first stage, the face 96 of the tool 94 engages the flange 142 in the operative position and bends it over the inner element 138 to a shape corresponding to the angle of the flange. This angle is typically in a range of 35° to 55°. In the second stage, the face 98 of the tool 94 engages the flange 142 to complete the secondary bending and finally create the hem.

It will be apparent that as the knee joint 56 approaches 180°, the downward force of the tool 94 is maximized. The amount of this downward force is adjustable. When the pull nut 106 is rotated downwardly, to move the tool support block 92 downwardly on the draw rod 82, the tool 94 will bottom out on the workpiece and/or the bed 12 when the knee joint 56 is at an angle of less than 180°. The vertical force transmitted through the linkage to the draw rod at this angle is less than it would be if the angle of the knee joint were greater. Thus, the downward force of the tool 94 is decreased. Conversely, when the pull nut 106 is rotated upwardly on the draw rod 82, the tool 94 will bottom out in the operative position when the knee joint is closer to 180°, and the downward force on the tool is greater. Typically, the downward force which can be delivered to the tool by the toggle joint can be as much as four times greater than the downward force available from a single lever of the prior art.

It will be apparent that the pull nut 106 and the wear washer 108 can be removed completely from the draw rod, and thereby permit the movable member 90 to be pivoted completely away from the work area. This feature enables easier access to the draw rod, and the connections between the draw rod and other components of the drive mechanism.

Although the drawings are not drawn to scale, it will be understood that the preferred arrangement will have the toggle joint 44 in substantial vertical alignment with the tool 94. Thus, bending moments and abnormal stresses on the bed 12 are avoided. Because all of the forces are self-contained, i.e., within the hemming structure rather than transmitted to the base or the floor through a frame, the alignment provides minimal deflection of the bed 12.

It can be seen that a hemming apparatus drive mechanism in accordance with the present invention permits the use of smaller pneumatic cylinders and lighter-weight materials to obtain greater forces. The amount of force to be applied to a given workpiece is adjustable, and the pivotable structure of the movable member 90 permits easier setup and maintenance of the device. It will also be apparent that the instant invention could find substantial benefit in applications other than hemming, such as hole piercing, metal forming, and notching operations. Reasonable variation and modifications are possible within the scope of the foregoing disclosure without departing from the spirit of the invention as defined in the appended claims.

The embodiments of the invention in which an exclusive property or privilege is claimed are defined as follows:

1. A drive mechanism for a hemming apparatus having a bed adapted to receive a workpiece comprising at least two superposed sheet materials to be hemmed, and a tool mounted to a movable member adapted to move toward and away from an operative position, the tool being disposed to engage the workpiece when the movable member is in the operative position, the drive mechanism comprising:

a frame fixedly mounted to the bed;

a pneumatic cylinder pivotally mounted to the frame, the cylinder having a shaft extending therefrom for reciprocating movement;

a toggle joint having first and second arms and a knee, the knee being pivotally connected to the shaft and the first arm being pivotally mounted to a lower portion of the frame;

a lever having first and second ends, said lever being pivotally mounted at a point intermediate the first and second ends to an upper portion of the frame, the first end of the lever being pivotally connected to the second arm;

and a draw rod having one end pivotally connected to the second end of the lever, the draw rod having another portion thereof connected to the movable member;

whereby when the pneumatic cylinder is energized, the shaft, the toggle joint, the lever, and the draw rod will cooperate to urge the movable member toward the operative position.

2. A drive mechanism according to claim 1 wherein the frame is suspended from the bed and the pivotal connections of the toggle joint with the lower portion of the frame and the first end of the lever, respectively, are substantially in vertical alignment with the tool.

3. A drive mechanism according to claim 2 wherein the movable member comprises a block which supports the tool, and the draw rod has means for adjusting the position of the block relative to the second end of the lever.

4. A drive mechanism according to claim 3 wherein the draw rod extends through an aperture in the block so that another end of the draw rod projects from the block, a push nut is mounted to the draw rod intermediate the block and the second end of the lever, and a pull nut is mounted to other end of the draw rod, the adjusting means comprising threads on the other end of the draw rod and the pull nut being threaded on to the other end.

5. A drive mechanism according to claim 2 further comprising an actuating mechanism mounted and between the frame and the movable member wherein the movable member is adapted to move toward and from a first stage position and a second stage position, respectively, the first stage position being a location above the bed from which the movable member is displaced vertically whereby the tool can preliminarily bend the workpiece when the movable member is in the operative position, and the second stage position being a location above the bed from which the movable member is displaced vertically whereby the tool can secondarily bend the workpiece when the movable member is in the operative position.

6. A drive mechanism according to claim 5 wherein the actuating mechanism comprises a pneumatic cylinder.

7. A drive mechanism according to claim 5 wherein the actuating mechanism comprises first and second pneumatic cylinders in axial alignment, the first cylinder being adapted to move the movable member to the first stage position, and the second cylinder being adapted to move the movable member to the second stage position.

8. A drive mechanism according to claim 2 wherein the movable member is biased away from the operative position.

9. A drive mechanism according to claim 1 wherein the first arm comprises a pair of parallel links which straddle and are pivotally connected to the second arm at the knee.

10. A drive mechanism according to claim 1 wherein the movable member comprises a block which supports the tool, and the draw rod has means for adjusting the position of the block relative to the second end of the lever.

11. A drive mechanism according to claim 10 wherein the draw rod extends through an aperture in the block so that another end of the draw rod projects from the block, a push nut is mounted to the draw rod intermediate the block and the second end of the lever, and a pull nut is mounted to other end of the draw rod, the adjusting means comprising threads on the other end of the draw rod and the pull nut being threaded on to the other end.

12. A drive mechanism according to claim 1 further comprising an actuating mechanism mounted to and between the frame and the movable member wherein the movable member is adapted to move toward and from a first stage position and a second stage position, respectively, the first stage position being a location above the bed from which the movable member is displaced vertically whereby the tool can preliminarily bend the workpiece when the movable member is in the operative position, and the second stage position being a location above the bed from which the movable member is displaced vertically whereby the tool can secondarily bend the workpiece when the movable member is in the operative position.

13. A drive mechanism according to claim 12 wherein the actuating mechanism comprises a pneumatic cylinder.

14. A drive mechanism according to claim 12 wherein the actuating mechanism comprises first and second pneumatic cylinders in axial alignment, the first cylinder being adapted to move the movable member to the first stage position, and the second cylinder being adapted to move the movable member to the second stage position.

15. A drive mechanism according to claim 10 further comprising an actuating mechanism mounted to and between the frame and the movable member wherein the movable member is adapted to move toward and from a first stage position and a second stage position, respectively, the first stage position being a location above the bed from which the movable member is displaced vertically whereby the tool can preliminarily bend the workpiece when the movable member is in the operative position, and the second stage position being a location above the bed from which the movable member is displaced vertically whereby the tool can secondarily bend the workpiece when the movable member is in the operative position.

16. A drive mechanism according to claim 15 wherein the actuating mechanism comprises a pneumatic cylinder.

17. A drive mechanism according to claim 15 wherein the actuating mechanism comprises first and second pneumatic cylinders in axial alignment, the first cylinder being adapted to move the movable member to the first stage position, and the second cylinder being adapted to move the movable member to the second stage position.

18. A drive mechanism according to claim 10 wherein the movable member is biased away from the operative position.

19. A drive mechanism according to claim 1 wherein the second arm has a stud projecting normally therefrom at the knee and the shaft is connected to the stud by a clevis.

20. A drive mechanism according to claim 1 wherein the movable member is biased away from the operative position.

* * * * *